US007011516B2

(12) United States Patent
Aust et al.

(10) Patent No.: US 7,011,516 B2
(45) **Date of Patent: *Mar. 14, 2006**

(54) INFRARED RADIATOR EMBODIED AS A SURFACE RADIATOR

(75) Inventors: Richard Aust, Mönchengladbach (DE); Juan Paniagua, Hückelhoven (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/916,100

(22) Filed: Aug. 11, 2004

(65) Prior Publication Data

US 2005/0069830 A1 Mar. 31, 2005

Related U.S. Application Data

(63) Continuation of application No. PCT/DE03/00401, filed on Feb. 11, 2003.

(30) Foreign Application Priority Data

Feb. 12, 2002 (DE) ..... 102 05 921
May 22, 2002 (DE) ..... 102 22 452

(51) Int. Cl.
*F23D 14/12* (2006.01)

(52) U.S. Cl. ..... 431/328; 431/329

(58) Field of Classification Search ..... 431/328, 431/329, 170, 7

See application file for complete search history.

(56) References Cited

U.S. PATENT DOCUMENTS

| | | | | |
|---|---|---|---|---|
| 3,529,916 | A * | 9/1970 | Krieger | 431/329 |
| 3,695,818 | A | 10/1972 | Mizutani | |
| 3,751,213 | A | 8/1973 | Sowards | |
| 4,861,261 | A * | 8/1989 | Krieger | 431/1 |
| 5,249,953 | A | 10/1993 | Roth | |
| 6,008,479 | A | 12/1999 | Jiang et al. | |
| 6,575,736 | B1 * | 6/2003 | Aust et al. | 431/328 |
| 6,665,950 | B1 * | 12/2003 | Riepe et al. | 34/266 |

FOREIGN PATENT DOCUMENTS

| | | |
|---|---|---|
| DE | 1 233 764 | 8/1967 |
| DE | 1 629 952 | 2/1972 |
| DE | 295 20 108 | 5/1997 |
| FR | 1 595 547 | 3/1968 |
| WO | WO 00/79045 | 12/2000 |

* cited by examiner

*Primary Examiner*—Alfred Basichas
(74) *Attorney, Agent, or Firm*—Taylor & Aust, P.C.

(57) ABSTRACT

A combustion chamber which is bounded on one side by a gas-permeable barrier, on the other side by a radiant element. The radiant element having a large number of ducts and emitting infrared radiation at its front surface. A jet plate with individual jets and the ducts of the radiant element are closed on the combustion chamber side, at least in the region of the outlet openings of the jets, by which baffle surfaces are formed, and toward which the outlet openings of the jets are aimed.

14 Claims, 4 Drawing Sheets

INFRARED RADIATOR EMBODIED AS A SURFACE RADIATOR

CROSS REFERENCE TO RELATED APPLICATIONS

This is a continuation of PCT application No. PCT/DE03/00401, entitled "INFRARED RADIATOR EMBODIED AS A SURFACE RADIATOR", filed Feb. 11, 2003.

BACKGROUND OF THE INVENTION

1. Field of the Invention

The present invention relates to an infrared radiator, and more particularly, an infrared radiator embodied as a surface radiator.

2. Description of the Related Art

Infrared radiators embodied as surface radiators are used in dryer systems which are used to dry web materials, for example, paper or board webs. Depending on the width of the web to be dried and the desired heating output, the requisite number of radiators is assembled with aligned emission surfaces to form a drying unit.

The basic structure of a single generic infrared radiator is illustrated in FIG. 8 and described, for example, in DE 199 01 145-A1.

The fuel/air mixture needed for the operation of the radiator is supplied to the radiator through an opening (a) in the housing (b) and firstly passes into a distribution chamber (c), in which the mixture is distributed uniformly over the radiator surface, at right angles to the view shown here. The gases then pass through a barrier (d) which is configured so as to be permeable. The main task of the barrier (d) is to isolate the combustion chamber (e), in which the gas is burned, from the distribution chamber (c), in which the unburned gas mixture is located, in such a way that no flashback from the combustion chamber (e) to the distribution chamber (c) can take place. In addition, the barrier (d) should expediently be designed such that the best possible heat transfer from the hot combustion waste gases to the solid element that emits the radiation, that is to say the surface of the barrier (d) itself or possibly the walls of the combustion chamber (e) and the actual radiant element (f) is prepared.

The geometric/constructional configuration of combustion chamber (e) and radiant element (f) is likewise carried out from the following points of view:

optimized heat transfer, maximized heat emission, minimum heat losses to the side and in the direction of the distribution chamber, taking into account thermal expansion which occurs and application specific special features, such as possible contamination, thermal shock which occurs, and so on.

U.S. Pat. No. 3,751,213 discloses a further generic infrared radiator, in which the radiant element includes a honeycomb element with continuous holes to carry the combustion gases away. The barrier ("gas injection block") is designed as a perforated ceramic plate. The main advantage described in the patent specification of the honeycomb element consists in the fact that the holes contained therein act as black radiators if their length/diameter ratio exceeds the value 5.

When assembling individual radiators to form drying units, these are normally ignited from the front through the radiant element. For this purpose, the openings in the radiant element must have a certain minimum area in order to ensure speedy thorough ignition of the gas operated infrared radiator of the drying unit. In the case of circular cross-sections, the minimum diameter is around 4 mm. This requirement, given the predefined length/diameter ratio, results in a minimum height of the honeycomb structure of 20 mm and therefore a comparatively large mass to be heated up. The relatively large openings in the radiant element, which are necessary in order to ignite the radiator, lead to relatively low gas velocities and therefore to a comparatively poor convective heat transfer from the combustion waste gases to the radiant element. Furthermore, no material is known at present which permits the construction of a barrier in the form described in U.S. Pat. No. 3,751,213 and at the same time withstands the very high combustion chamber temperatures typical of this construction for a relatively long time.

What is needed in the art is an infrared radiator which has an improved convective heat transfer with high service life.

SUMMARY OF THE INVENTION

The present invention provides an infrared radiator with improved heat transfer and high service life.

The invention comprises, in one form thereof, a combustion chamber which is bounded on one side by a gas-permeable barrier, on the other side by a radiant element. The radiant element having a large number of ducts and emitting infrared radiation at its front surface. A jet plate with individual jets and the ducts of the radiant element are closed on the combustion chamber side, at least in the region of the outlet openings of the jets, by which baffle surfaces are formed, and toward which the outlet openings of the jets are aimed.

The jets, as passage openings, have the effect of a high outlet velocity, which is fundamental for an efficient, convective heat transfer. Because of the high velocity, the baffle surfaces prevent the flame only forming within the radiant element, and thus no sufficient heat transfer taking place at the latter. The effect of the baffle surfaces, in conjunction with the jet array of the jet plate, is thus the maximum, effective heat transfer.

The dependent claims contain refinements of an infrared radiator according to the invention which are preferred, since they are particularly advantageous.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
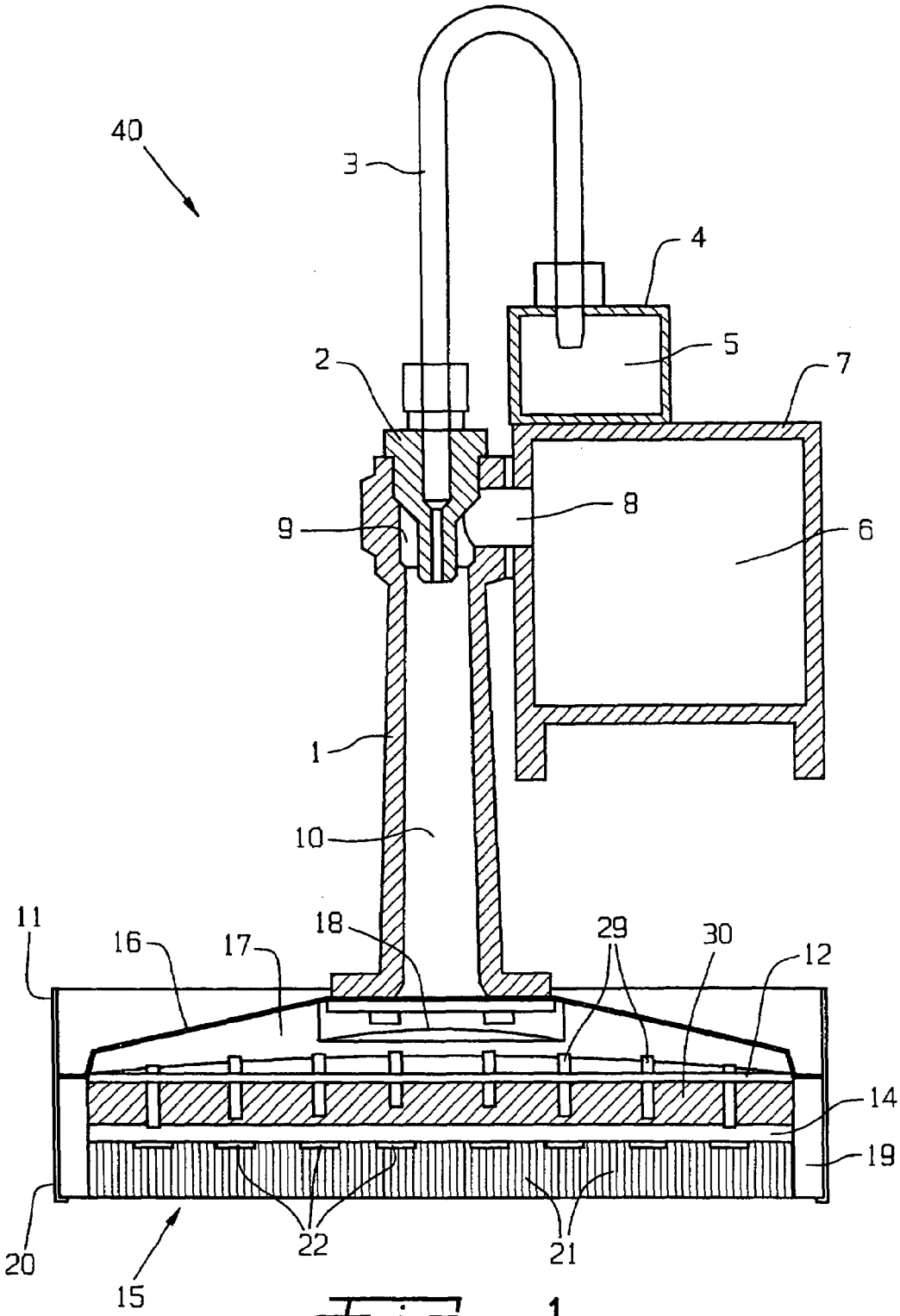
FIG. 1 is a cross-sectional view through the structure of an infrared radiator according to the present invention.

Referring now to the drawings, and more particularly to FIG. 1, each radiator 40 contains a mixing pipe 1, into which a mixing jet 2 is screwed at one end. Connected to mixing jet 2 is a gas supply line 3, which is connected to a manifold line 4, from which a plurality of radiators arranged beside one another are supplied with gas 5. The supply with air 6 is provided via a hollow cross member 7, to which mixing pipe 1 is fixed. A connecting line 8 for the air supply opens in the upper part of mixing pipe 1 into an air chamber 9 which is open at the bottom and surrounds the outlet end of mixing jet 2, so that a gas-air mixture is introduced into mixing chamber 10 of mixing pipe 1 from above.

The infrared radiators according to the present invention are preferably heated with gas; alternatively, heating with a liquid fuel as a heating fluid is possible.

Fixed at the lower, open end of mixing pipe 1 is a housing 11, in which a jet plate 12 is arranged as a barrier. The jet plate 12 is fabricated from a heat-resistant metal and contains a series of tubular jets 29, which are likewise fabricated from metal. Jets 29 open into a combustion chamber 14, which is bounded on one side by jet plate 12 and on the other side by a radiant element 15 arranged substantially parallel to and at a distance from the latter. In combustion chamber 14, flames are formed, which heat radiant element 15 from the rear, so that it emits infrared radiation. On the side of combustion chamber 14, jets 29 are embedded in a vacuum-formed plate 30, which is formed of high temperature resistant ceramic fibers. Alternatively, the plate can be replaced by a plurality of layers of ceramic paper. Plate 30 acts as an insulating layer for jet plate 12 and thus prevents it being damaged by the high temperatures in combustion chamber 14, apart from flashbacks. This combined construction, including metallic jet plate and ceramic fiber insulation, is substantially more resistant to crack formation than the known perforated ceramic plates which are often used as a barrier. The diameter of a jet 29 is 1.5–4 mm, the jet plate 12 containing about 1500–2500 jets 29 per $m^2$ of its surface.

For the supply of the gas-air mixture, mixing pipe 1 opens into a distribution chamber 17, which is sealed off by a hood 16 and is connected to the other end of jet plate 12. In order that the gas-air mixture is distributed uniformly on the rear of jet plate 12, a baffle plate 18, against which the mixture supplied flows, is arranged in distribution chamber 17. Jet plate 12 is fitted in housing 11 in peripheral, fireproof seals 19. Radiant element 15 hangs in a peripheral fireproof frame 20, which is fixed to housing 11 or is part of the latter and, together with seals 19, terminates combustion chamber 14 in a gastight manner at the sides.

Radiant element 15 is fabricated from ceramic or another highly heat resistant material. It is preferably fabricated from a suitable SiC modification or a material which contains more than 50% by weight of a metal silicide as its main constituent. The metal silicides used are preferably molybdenum disilicide ($MoSi_2$) or tungsten disilicide ($WSi_2$). Silicon oxide ($SiO_2$), zirconium oxide ($ZrO_2$) or silicon carbide (SiC) are preferably contained as further constituents. These materials are extremely temperature resistant and stable, so that the radiator, if necessary, can be operated with flame temperatures of more than 1700° C. up to 1850° C. As compared with a likewise high temperature resistant alloy which consists exclusively of metals (for example a metallic heat conductor alloy), the material has the further advantage that virtually no scaling occurs. In order to obtain an extremely long service life of the radiator, this can be operated with a flame temperature somewhat below the maximum possible temperature of the radiant element 15; for example between 1100° C. and 1400° C., by which the formation of thermal $NO_x$ is kept within tolerable bounds.

Figure 3:
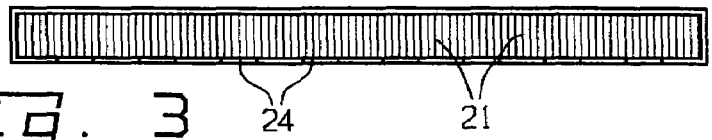
FIG. 3 is a cross-sectional view of the radiant element of FIG. 2.

In all the embodiments, the radiant element contains a large number of ducts 21 which, as illustrated in FIGS. 1 and 3, extend outward from combustion chamber 14. Ducts 21 are heated at the rear of radiant element 15 bounded by combustion chamber 14. On the front side of radiant element 15, ducts 21 are open; they emit the infrared radiation there. The cross-section of tubular ducts 21 is preferably either circular or in the form of a regular polygon, for example ducts 21 are arranged beside one another in a honeycomb form.

It is important for the invention that ducts 21 of the radiant element are closed on the combustion-chamber side, at least in the region of the outlet openings of jets 29. In this way, baffle surfaces 22 are formed, toward which outlet openings of jets 29 are aimed. Baffle surfaces 22 ensure that the flames are already formed in combustion chamber 14 and not just within ducts 21. Thus, the maximum convective heat transfer is effected.

Figure 2:
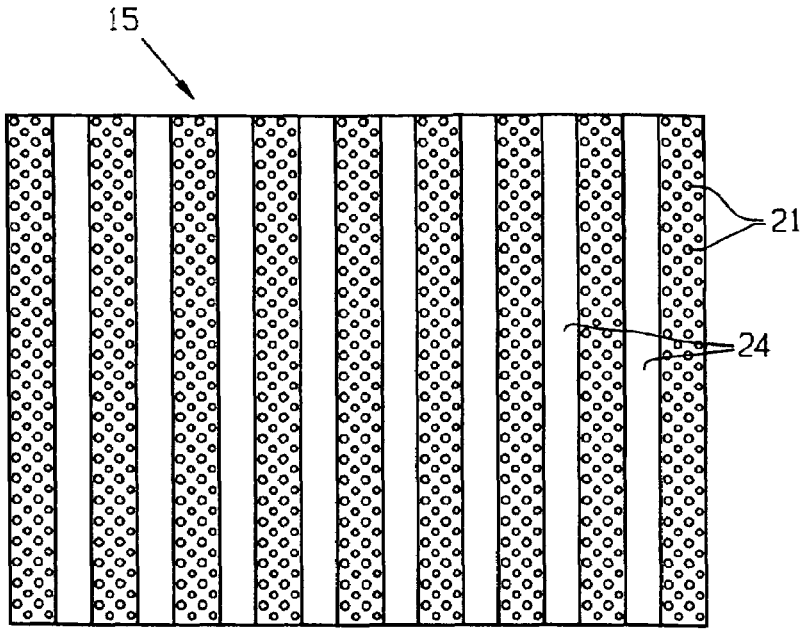
FIG. 2 is a plan view of the combustion chamber side of the radiant element of FIG. 1.
Figure 4:
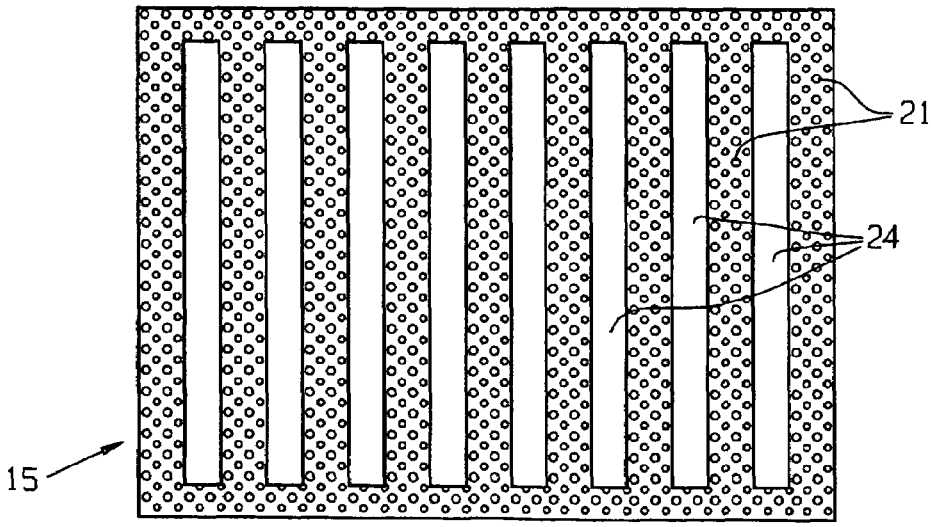
FIGS. 4 and 5 each show a plan view of the combustion chamber side of two other embodiments of a radiant element according to the present invention.
Figure 5:
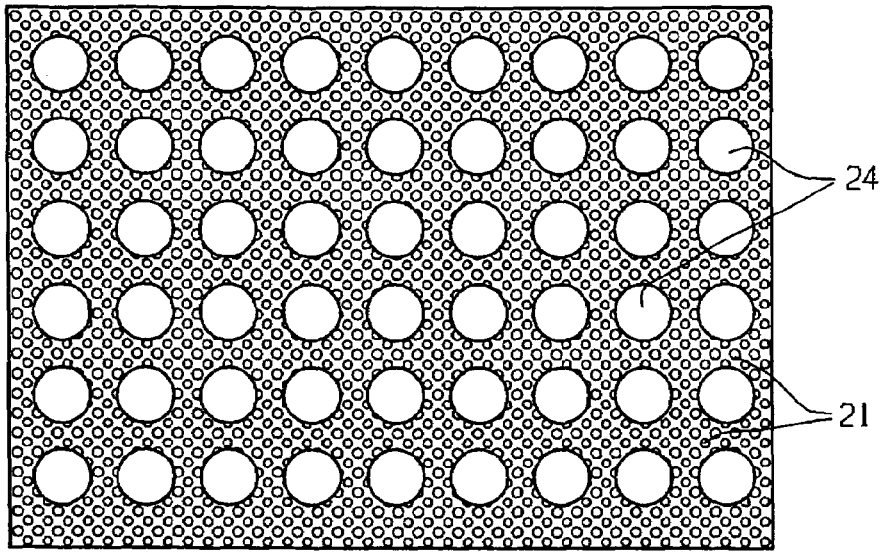

FIGS. 2–5 illustrate various embodiments of a radiant element 15 produced from a block. Ducts 21 have very small diameters, so that the requisite minimum height of radiant element 15 (=length of ducts 21) for reaching a high emission coefficient is reduced. In this way, the mass of the radiant element that is to be heated up overall is reduced, with the advantage that the heating and cooling times of the radiator are shortened. On the combustion chamber side, which is shown in FIGS. 2, 4 and 5, ducts 21 are closed in the region of the outlet openings of jets 29. For this purpose, strip-like (FIG. 2, FIG. 4) or circular (FIG. 5) plates 24 are fitted to the surface of the radiant element 15 or incorporated in the surface in the appropriate regions. The plates preferably include the same fireproof material from which the rest of radiant element 15 is fabricated. It is thus possible, during the production of radiant element 15 from a standardized material, to configure ducts 21 to be closed in the appropriate regions.

Figure 6:
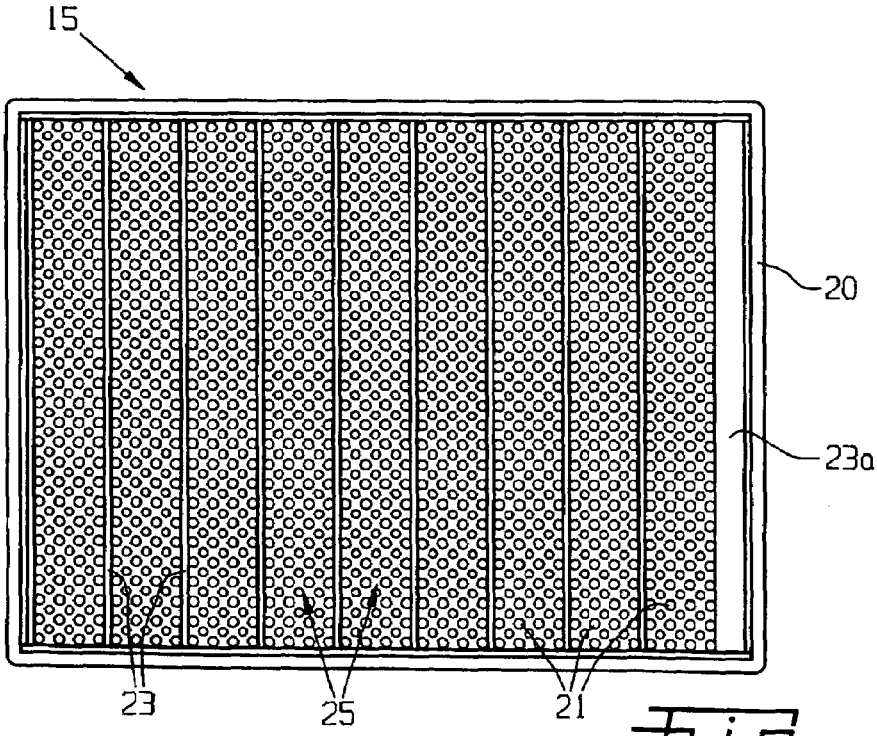
FIGS. 6 and 7 each show plan views of two embodiments of the radiant front side of radiant elements built up from individual strips according to the present invention.
Figure 7:
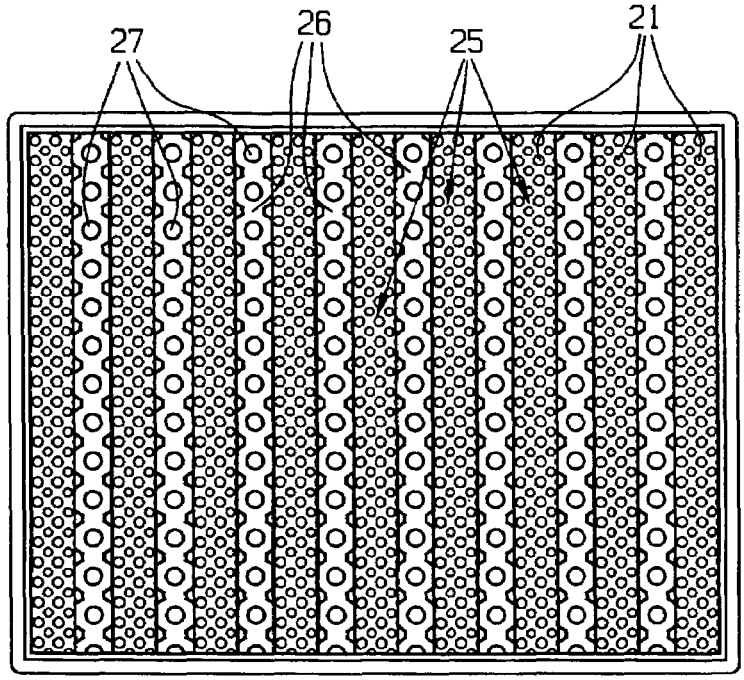
Figure 8:
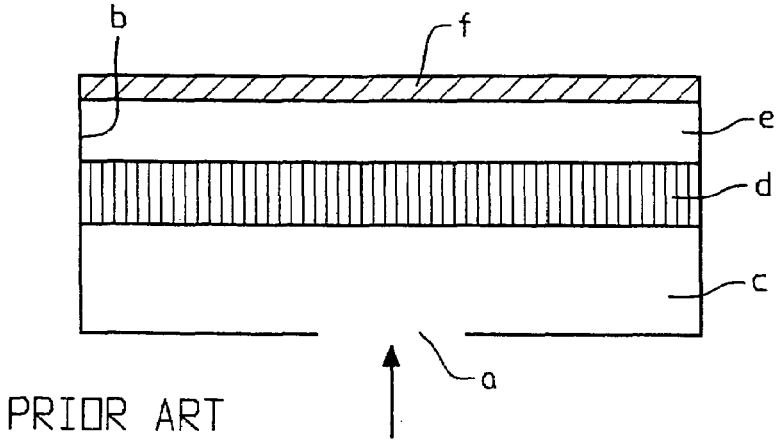
FIG. 8 is a cross-sectional view of the basic structure of a radiator housing.

In the embodiments according to FIGS. 6 and 7, radiant element 15 is built up from individual bar-like elements 25 arranged beside one another, which are in each case fixed with their ends in frame 20. Each of the elements 25 contains a large number of ducts 21, which are closed on the combustion chamber side in the manner described above and are open on the front side of the radiator, illustrated in FIGS. 6 and 7. Between the individual elements 25 there are openings 23, which permit removal of the combustion waste gases from combustion chamber 14.

In the embodiment according to FIG. 6, there are narrow slots between individual elements 25 as openings 23. At least one slot 23*a* of the radiator is designed to be wider, in order that ignition of the radiator from outside is made possible. The clear width of the slot 23*a* is at least 4 mm for this purpose.

In the embodiment according to FIG. 7, in each case a further bar-like element 26, which has continuous ducts 27 with an enlarged cross section, is arranged between two bar-like elements 25. The combustion waste gases are removed from the combustion chamber 14 through continuous ducts 27. The diameter of ducts 27 is at least 4 mm, so that the radiator can also be ignited from outside through these ducts 27. Channels 21 of elements 25 have a considerably smaller diameter. They are closed on the combustion chamber side in the manner described above.

Because of their possible use at very high temperatures of more than 1100° C., their high specific power density and their long service life, the infrared radiators according to the invention are particularly suitable for drying web materials at high web speeds. One preferred area of application is the drying of moving board or paper webs in paper mills, for example downstream of coating apparatus.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An infrared radiator embodied as a surface radiator, comprising:

a combustion chamber including a first side and a second side, said combustion chamber being bounded on said first side by a gas permeable barrier, said combustion chamber being bounded on said second side by a radiant element, said radiant element having a combustion chamber side and a front surface, said radiant element having a large number of ducts at said front surface, said radiant element emitting infrared radiation at said front surface, said gas permeable barrier including a jet plate having a plurality of individual jets including a plurality of outlet openings, said large number of ducts being closed on said combustion chamber side at least in a region of said outlet openings by which a plurality of baffle surfaces are formed, said outlet openings being aimed toward said plurality of baffle surfaces, wherein said large number of ducts are closed on said combustion chamber side by at least one of a plurality of strip-like plates and a plurality of circular plates.

2. The infrared radiator of claim 1, wherein said radiant element is fabricated from a block.

3. The infrared radiator of claim 1, wherein said radiant element is built up from a plurality of individual bar-like elements which contain said large number of ducts, each of said plurality of individual bar-like elements is arranged at a distance from an other of said plurality of individual bar-like elements.

4. The infrared radiator of claim 3, further including a plurality of slots as openings between said plurality of individual bar-like elements, at least one said plurality of slots having a width of at least 4 mm.

5. The infrared radiator of claim 3, further including a bar-like element having a plurality of continuous ducts with an enlarged cross-section, said bar-like element being arranged between two of said plurality of individual bar-like elements.

6. The infrared radiator of claim 1, wherein both said jet plate and said plurality of individual jets are fabricated from a heat-resistant metal, said plurality of individual jets are embedded in a vacuum formed plate formed of a plurality of ceramic fibers.

7. The infrared radiator of claim 6, wherein said vacuum formed plate is formed of a plurality of layers of ceramic paper.

8. The infrared radiator of claim 1, wherein said radiant element is produced from a silicon carbide (SiC) modification.

9. The infrared radiator of claim 1, wherein said radiant element is produced from a highly heat resistant material which contains more than 50% by weight of a metal silicide.

10. The infrared radiator of claim 9, wherein said radiant element contains more than 50% by weight of a molybdenum disilicide ($MoSi_2$).

11. The infrared radiator of claim 9, wherein said radiant element contains more than 50% by weight of a tungsten disilicide ($WSi_2$).

12. The infrared radiator of claim 9, wherein said radiant element contains a silicon oxide ($SiO_2$) as a further constituent.

13. The infrared radiator of claim 9, wherein said radiant element contains a zirconium oxide ($ZrO_2$) as a further constituent.

14. The infrared radiator of claim 9, wherein said radiant element contains a silicon carbide (SiC) as a further constituent.

* * * * *